US006652178B2

(12) United States Patent
Walton

(10) Patent No.: US 6,652,178 B2
(45) Date of Patent: Nov. 25, 2003

(54) ORGANIZING AND STORAGE SYSTEM FOR CARDS

(76) Inventor: Michael G. Walton, P.O. Box 722, Bellingham, WA (US) 98227-0722

( * ) Notice: Subject to any disclaimer, the term of this patent is extended or adjusted under 35 U.S.C. 154(b) by 0 days.

(21) Appl. No.: 09/933,081

(22) Filed: Aug. 20, 2001

(65) Prior Publication Data

US 2003/0059248 A1 Mar. 27, 2003

(51) Int. Cl.[7] ..... B42F 13/00
(52) U.S. Cl. ..... 402/79; 402/80 K; 281/38
(58) Field of Search ..... 402/79, 73, 70, 402/4; 281/38, 31, 45

(56) References Cited

U.S. PATENT DOCUMENTS

| | | | | | |
|---|---|---|---|---|---|
| 3,540,646 | A | | 11/1970 | Kizler | 229/72 |
| 3,648,832 | A | | 3/1972 | Kirshenbaum | 206/39 |
| 3,678,602 | A | | 7/1972 | Alam | 35/35 J |
| 3,688,896 | A | | 9/1972 | Newell | 206/39 |
| D272,748 | S | | 2/1984 | Kirk | D19/8 |
| 4,571,867 | A | | 2/1986 | Williams | 40/405 |
| 4,614,450 | A | | 9/1986 | Neiman | 402/79 |
| 4,645,077 | A | | 2/1987 | McLaughlin et al. | 206/232 |
| 4,906,057 | A | | 3/1990 | Davi et al. | 312/193 |
| 5,042,841 | A | | 8/1991 | Friedman | 281/29 |
| 5,080,223 | A | | 1/1992 | Mitsuyama | 206/39.5 |
| 5,125,561 | A | | 6/1992 | Idstein | 229/400 |
| D340,473 | S | | 10/1993 | Dubs | D19/33 |
| 5,275,438 | A | | 1/1994 | Struhl | 281/31 |
| 5,316,404 | A | * | 5/1994 | Hensel | 402/79 |
| 5,501,540 | A | * | 3/1996 | Ho | 402/79 X |
| 5,573,110 | A | | 11/1996 | Nguyen | 206/39 |
| 5,620,271 | A | | 4/1997 | Bergh et al. | 402/79 |
| 5,749,666 | A | | 5/1998 | Yu | 402/18 |
| 5,938,242 | A | * | 8/1999 | Ryan | 402/79 X |
| 5,992,618 | A | | 11/1999 | Joh | 206/39 |
| 6,135,662 | A | * | 10/2000 | Bakke et al. | 402/79 |

* cited by examiner

*Primary Examiner*—Willmon Fridie, Jr.

(57) ABSTRACT

The Small Card Organizer, or simply "Organizer", is an accessory that fits into a notebook binder and enables users to organize and transport card materials, especially educational flashcards. The Organizer is typically composed of a substrate (such as a three-ring binder insert sheet) to which is mounted a number of miniature-sized pouches called carriers. The carriers, enclosed on the bottom, front, side and back, provide a single opening through their top for inserting flashcards, but also for business cards, index cards, and photographs. To keep card materials from falling out through the carriers' openings, retaining members are also provided with the Organizer. Retaining members, most commonly resembling flaps, are fixed in place to the substrate or carriers.

5 Claims, 11 Drawing Sheets

ORGANIZING AND STORAGE SYSTEM FOR CARDS

CROSS REFERENCE TO RELATED APPLICATIONS

Not Applicable

FEDERALLY SPONSORED RESEARCH & DEVELOPMENT

Not Applicable

BACKGROUND

1. Field of Invention

Figure 1:
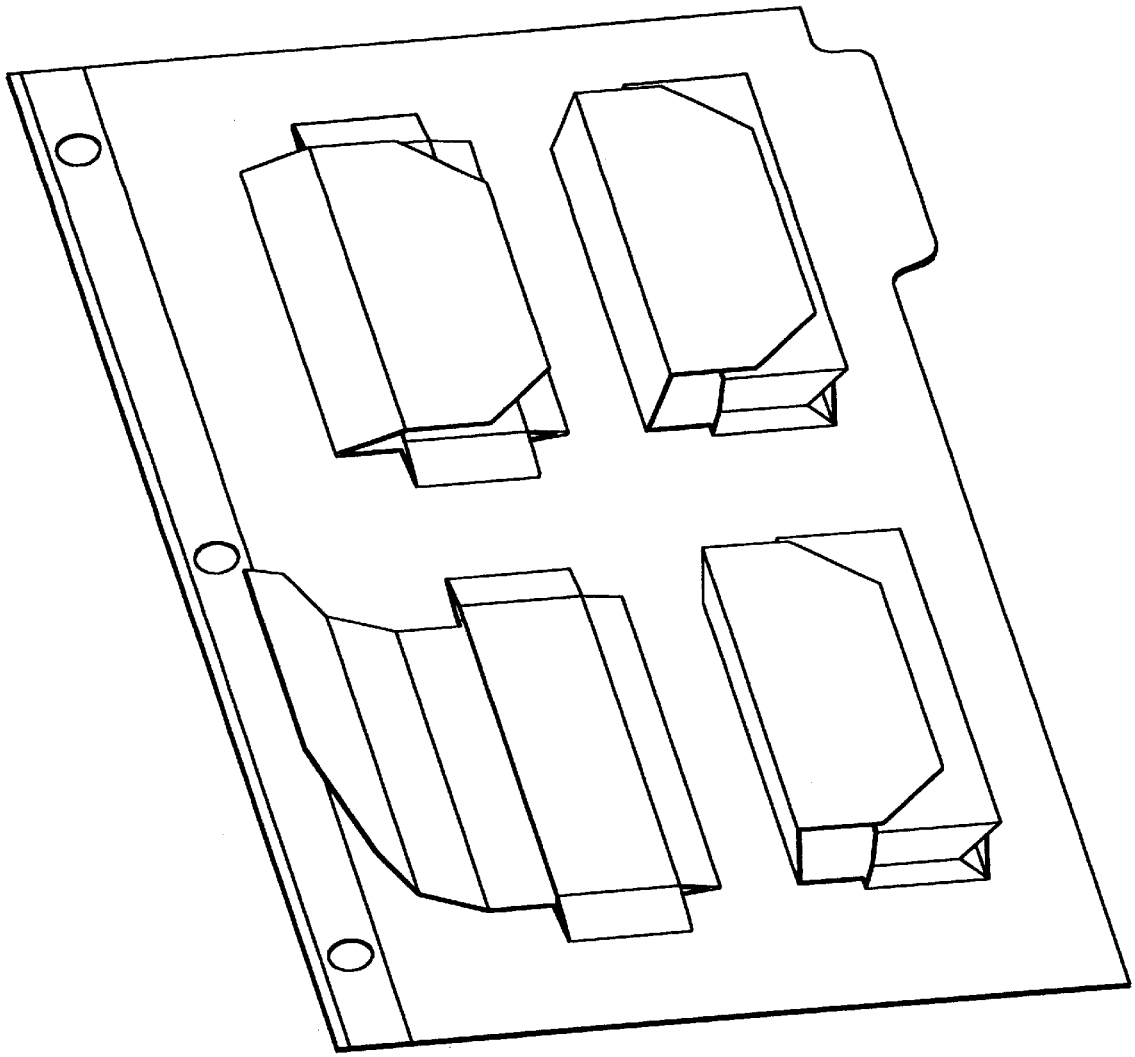

This invention relates to an organizational accessory, and pertains especially to a three-ring notebook binder accessory into which small cards including educational flashcards and business cards are easily inserted, sorted into groups, and transported.

My invention is called "An Organizing and Storage System for Cards," hereafter referred to as either "Small Card Organizer" or simply "Organizer."

2. Discussion of Prior Art

One of the problems with learning a new vocabulary such as a foreign language or with organizing vast amounts of information is the ability to organize and manage information easily to facilitate learning. One learning tool for learning vast amounts of information is flashcards. But flashcards, often used in large quantities, need to be managed and organized. For learning and using flashcards, individuals need an organizing system that:

compactly carries and stores flashcards, provides a place in which to segregate and organize flashcards, facilitates fast manipulation of flashcards.

There are some systems available today, such as metal key rings and rubber bands, but there is no known system that provides the ability to easily carry, categorize and reorganize cards easily.

Students learning any subject including foreign language are always looking for ways to organize information in a manner that helps them increase their retention. One learning tool for learning vast amounts of information is flashcards. Students using flashcards will often take a large stack of flashcards and divide them into smaller and manageable chunks. Out of a stack of 100 flashcards, users may easily learn 40 words, with one word per flashcard, but have problems learning the remaining 60. So from the stack of 100, they remove the first 40 flashcard, bind them together with a rubber band, and call the new smaller stack "Expert-Level". Next, they divide the remaining 60 cards into two subgroups. If 45 flashcards are somewhat difficult to learn (but not extremely difficult), they will segregate those 45 flashcards and place them into a stack identified as "Intermediate-Level."

The remaining 15 (and more difficult) flashcards become a third stack titled "Difficult-Level." These 15 words will now be easier to learn because psychologically, the task looks much smaller, and tactically, problems divided are problems that have been resolved. Over a week's time, users will learn many of the Difficult-Level words and then migrate them toward the expert-level stack. Both the Difficult-Level Stack and the Intermediate-Level Stack will gradually become smaller while the expert-level stack becomes larger.

Managing and organizing many flashcards, however, can be challenging. For example, rubber bands are often used to keep the flashcard stacks intact, however, rubber bands can be cumbersome. Rubber bands hold together flashcards, but they make it difficult to insert or withdraw flashcards from a stack. This requires that one remove the rubber band. But Repeatedly banding and un-banding stacks with rubber bands is cumbersome and detracts from learning efforts, so one may intentionally leave stacks un-banded or loose while working with them. But loose stacks can get easily get mixed up with cards from other stacks, especially considering that flashcards should be handled quickly, in split-second operations, shuffled quickly from hand-to-stack and between categorized stacks. Students who use flashcards while commuting on a bus will need to give attention and account for flashcards that might have fallen to the floor. Rubber bands break if they are stretched too tightly or used frequently. Another drawback to rubberbanding is that bundled flashcards are not comfortable in one's pant pockets. In a student's backpack, cards-stacks are small enough to settle to the bottom, thus making them a nuisance to locate later. Flashcard bundles can be misplaced, left in yesterday's coat pocket, or accidentally left on the nightstand. Related flashcard stacks can get separated from each other.

Another popular solution for managing flashcards is to use flashcards that are bound together on a metal ring such as those holding car keys, house keys, etc. . . . Each flashcard has a small hole through which the ring may penetrate thereby holding all cards together. Although this method does keep cards together, the flashcards on a key ring is a serial-file and does not allow for easy management, rapid sorting, or re-categorizing of cards during the learning process.

In summary, the problem with organizing vast amounts of information on flashcards creates a demand for a management system that makes it easy to transport, store and easily categorize flashcards.

Cited below are a listing of patents that were found to be related to notebook binders or card organization.

Design Patent D340,473 (Oct. 19, 1993, Connie M. Dubs, "Loose-Leaf Binder sheet for Organizing Coupons") is a coupon organizer. Within each coupon receptacle, however, flashcards would disperse within the envelope due to the envelope's large size, therefore users would have to reach into envelope and feel for the cards before retrieving them. It is uncertain if the envelope depth is deep enough to hold the desired quantity of cards. In any event, users would have to manipulate or "wiggle" any additional flashcards into the envelope if, already, there were flashcards held in the recesses of the large envelope. Although only a slight problem for coupon use, getting flashcards to fit in among other cards would become a nuisance; the work with flashcards ought to be quick and frequent.

Design Patent D272,748 (Feb. 21, 1984, Velma R. Kirk, "Pocket Insert for Notebook") is a three-ring binder insert with receptacles for paper and other unspecified items. For use as a flashcard organizer, drawbacks to this patent include those encountered with D340,473 (the Coupon Organizer). An additional drawback is that this design fails to provide a satisfactory means to secure flashcards from becoming dislodged from the envelope.

U.S. Pat. No. 3,540,646 (Nov. 17, 1970, John W. Kizler, "File Envelope Having Side-By-Side Extensible Pockets") is a two-pocket holder. It provides a curved indentation on the envelopes' front wall for improved access to enclosed items, two side-by-side pouches, and a single and a single flap to hold contents in either pocket. It is problematic, however, that a common wall is shared by two pockets. When the pockets are compressed (as if a stack of books were placed on top) the common wall between them deflects away from one of the pockets but in toward the other pocket. This would take space intended for flashcards in pocket two and introduce an obstacle against inserting flashcards. The user may be required to use one hand to spread wider the envelope opening while using the other hand to insert Flashcards. The common wall has a second drawback: the tab that secures it to the back wall of the pockets is exposed to items being inserted into one of the pockets, and it would becomes a nuisance-obstacle against frequent and rapid insertion of flashcards into that pocket.

U.S. Pat. No. 3,688,896 (Sep. 5, 1972, Strohm Newell, "Card Case") and U.S. Pat. No. 5,992,618 (Nov. 30, 1999, Duksung Joh, "Pocket Carrier of Index Cards") are both rigid index card boxes. While the cases are transporters of cards, they are not categorizing tools, neither do they plug into notebook binders, and they are bulky.

U.S. Pat. No. 5,042,841 (Aug. 27, 1991, Michael N. Friedman, "Combined Cover and Storage Compartment for a Ring Binder") and U.S. Pat. No. 5,125,561 (Jun. 30, 1992, Idstein Wilfried, "Folio Including Filing Perforations") are storage compartments for transporting contents, but they do not provide for plurality of envelopes to help sort or categorize cards.

U.S. Pat. No. 4,906,057 (Mar. 6, 1990, Richard A. Davi, "Closed Portable Card File") is an index card case suitable for organizing cards numerically or alphabetically, but the box is much larger in volume than required for flashcard use, and it is neither convenient for transport in a backpack nor within a notebook binder.

U.S. Pat. No. 4,614,450 (Sep. 30, 1986, Rhoda Neiman, "Portable Index Card Holder for Notebooks") is a holder in which to organize index cards for display purposes, and it would be well suited for categorizing meal recipes or photographs. This holder's pockets, however, are neither suitable for rapidly inserting or withdrawing cards, nor for inserting (or categorizing) large quantities of cards into any given pocket.

U.S. Pat. No. 4,571,867 (Feb. 25, 1986, Marvin E. Williams, "Information Organizing Device") is a three-ring binder insert with numerous card receptacles, and each receptacle is accessed through a slit-like aperture for inserting a card. While the system allows users to organize and rank individual cards, any one receptacle is not well-suited to accommodate more than one card each, and each slit's aperture is unsuitable for frequent and rapid insertion of cards.

U.S. Pat. No. 5,275,438 (Jan. 4, 1994, Warren Struhl, "File Folder with Attached Computer Disc Pocket"), and U.S. Pat. No. 5,620,271 (Apr. 15, 1997, James A. Bergh, "Three-Ring Binder Page for Holding Compact Disks") are binder inserts intended to hold compact disks or floppy disks. These types of products have pockets that are intended to tightly hold their intended contents, but they would not lend well to frequent, rapid and recurring insertion and removal of contents.

Investigation of prior art has discovered pertinent organizational and storage accessories, but none are known to provide all of the following:

- facility to compactly carry and store flashcards,
- multiple pockets or envelopes in which to segregate and organize flashcards,
- design and size of card carrier to permit easy and frequent deposit/withdrawal of flashcards into any given pocket or envelope.

SUMMARY OF INVENTION

The Small Card Organizer, or simply "Organizer", is an accessory that fits into a notebook binder. It is typically composed of a substrate (such as a three-ring binder insert sheet), and to it are mounted a number of miniature-sized pouches called carriers. The carriers, enclosed on the bottom, front, side and back, provide a single opening through their top for inserting card materials. To keep card materials from falling out through the carriers' openings, retaining members are also provided with the Organizer. Retaining members, which resemble flaps, are fixed to the substrate or carriers.

OBJECTS AND ADVANTAGES

The Organizer is a system of pouch-like carriers for holding and categorizing flashcards. Each of its carriers compactly hold flashcards in a neatly arrayed manner, and their construction enable easy insertion and withdrawal flashcards. The plurality of carriers give users plenty of places in which to categorize their flashcards. The Organizer is a long-term storage holder and a conveniently-sized, modular transporting vessel. The Organizer reduces the amount of time that a user spends on flashcard administration and maximizes time spent on learning flashcard content.

The Organizer helps manage a large quantity of flashcards. Foreign language, natural sciences, and law are typical studies that require learning new vocabularies. The Organizer is a tool to help learn those vocabularies. Users can engage in rapid flashcard review and focus on learning content. After completion of a flashcard study session, the Organizer securely holds each group of flashcards within their respective carriers.

The Organizer's carriers are designed and manufactured so that both inserting and withdrawing flashcards is an ergonomically easy operation. A set of accordion-folds on each carrier will allow the carrier to compress in volume to absorb any displacement caused by pressure applied by a closed notebook binder that is in a backpack or under a stack of books. Each Organizer has at least one retaining member (or flap) to keep cards from dislodging from within the carriers when flashcards are being transported. Durable carriers, retaining-member(s) and substrate can be economically-made from paper cardstock.

Each carrier is assigned a certain flashcard category. When users want to study flashcards from a certain category, they know where to find them. Users who only have 5-minutes to study during lunch break (or prior to exam-time) will open their three-ring binders and, within seconds, be reviewing the flashcards that they targeted. The Organizer will provide educational return on each session of study whether 3 hours or 3 minutes.

Notebook binders make it easy to organize learning materials such as course syllabus, lecture notes, homework assignments, etc. Notebook binders are an equally logical place for keeping flashcards. Flashcards assigned to a notebook binder will rarely be lost or misplaced.

The Organizer will enable users to work with an unusually large quantity of flashcards and to do so methodically and rapidly. It allows users to reliably retain cards within their categorized groups and transport them while maintaining integrity of organization. Users can divert their attention from administering flashcards while committing more attention to learning flashcards' content. Further objects and advantages will become apparent from a consideration of the drawing and ensuing description.

| FIG. # | Description of Figure: |
|---|---|
| 1 | Card Organizer, Main Embodiment |
| 2 | Card Organizer, Main Embodiment, with Part Call-Outs |
| 3 | View of Carrier and Retaining Member |
| 4 | Construction of Carrier and Identification of Components (FIG. 4-A through FIG. 4-J) |
| 5 | Final Assembly of Organizer (FIG. 5-A through FIG. 5-D) |
| 6 | Operational Illustration of Main Embodiment |
| 7 | Alternative Embodiments (FIG. 7-A through FIG. 7-D) |

REFERENCE NUMERALS, LIST OF

| Id #: | Component Description: |
|---|---|
| 20 | Carrier |
| 22 | Substrate |
| 24 | Retaining Member |
| 30 | Binding Means |
| 32 | ID Tab |
| 40 | Card Stock |
| 50 | Perimeter Cut-Line |
| 60 | Score Lines (shown as dashed) |
| 61 | Floor Accordion Score Line |
| 62 | Side-Wall Accordion Score Line |
| 63(A) | Carrier Front Score Line |
| 63(B) | Carrier Back Score Line |
| 64(A) | Floor Front Score Line |
| 64(B) | Carrier Back-Bottom Score Line |
| 65 | Retaining Member Front Score Line |
| 66 | Retaining Member Back Score Line |
| 80 | Carrier/Retainer Blank |
| 81 | Back Wall |
| 82(A) | Assembly Tab |
| 82(B) | Tab Landing |
| 83(A) | Right-Forward-Panel $83A |
| 83(B) | Right-Aft-Panel $83B |
| 84(A) | Left-Forward-Panel $84A |
| 84(B) | Left-Aft-Panel $84B |
| 85 | Carrier Front Face |
| 86 | Retaining Member Top |
| 87 | Retaining Member Front |
| 88A | Flap Fastener—Part A |
| 88B | Flap Fastener—Part B |
| 89(A) | Floor Forward-Panel |
| 89(B) | Floor Aft-Panel |
| 90 | Carrier Construction Adhesive |
| 95 | Carrier Mounting Adhesive |
| 96 | Carrier/Retainer Attach Mechanism B |
| 97 | Carrier/Retainer Attach Mechanism A |
| 101 | Pouch: Introductory Level Vocabulary |
| 102 | Pouch: Intermediate Level Vocabulary |
| 103 | Pouch: Expert Level Vocabulary |
| 104 | Pouch: Auxiliary |
| 201 | Bottom Harness |
| 202A | Right Harness |
| 202B | Left Harness |
| 210 | Aperture |

DESCRIPTION—MAIN EMBODIMENT OF INVENTION

FIG. 1 depicts the main embodiment of the Organizer.

Figure 2:
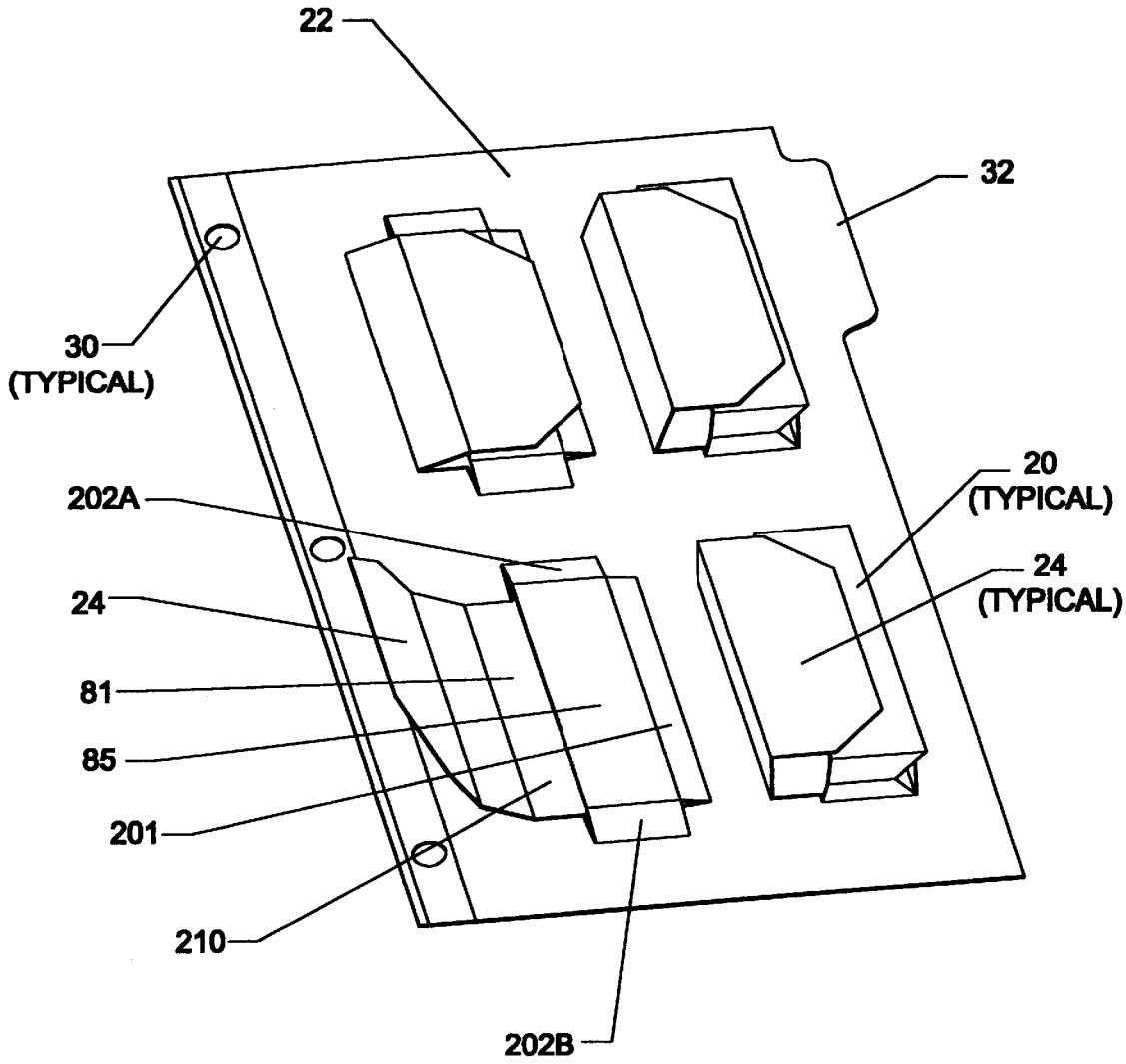

FIG. 2 depicts the main embodiment of the Organizer with its components identified. Generally, the Organizer comprises carriers #20 which carry cards, a substrate #22 to which carriers #20 are mounted, and retaining members #24 to keep cards within carriers #20 during transport. For this embodiment, four #20 are mounted onto substrate #22 and each carrier #20 is provided with its own retaining member #24. Carrier #20 is composed of front-wall #85, right-harness #202A, left-harness #202B, bottom-harness #201, and back-wall #81. The top side of carrier #20 has aperture #210 through which card materials can slide into and out of carrier #20. For this embodiment, a commercially-available, three-ring binder sheet is chosen for substrate #22. It includes binder-holes #30 for insertion into a notebook binder. When in a notebook, a tab #32 enables the user to turn quickly to the correct Organizer. FIG. 2 also depicts one of the flap-like retaining-members #24 in the "open" position.

Figure 3:
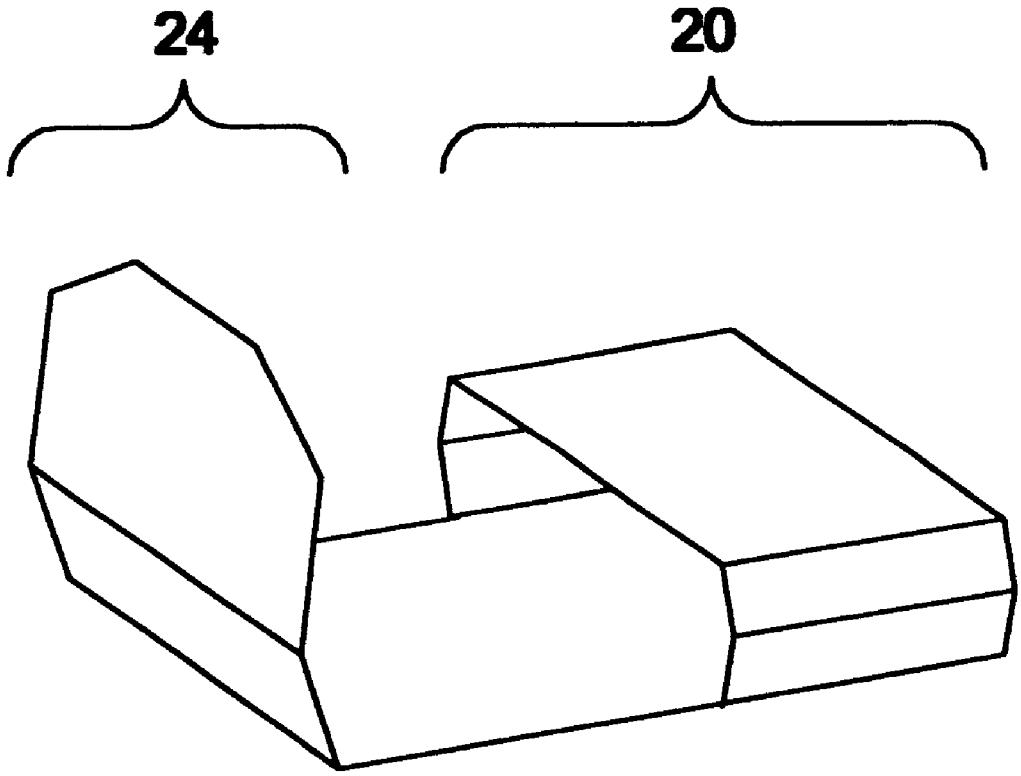
Figure 4A:
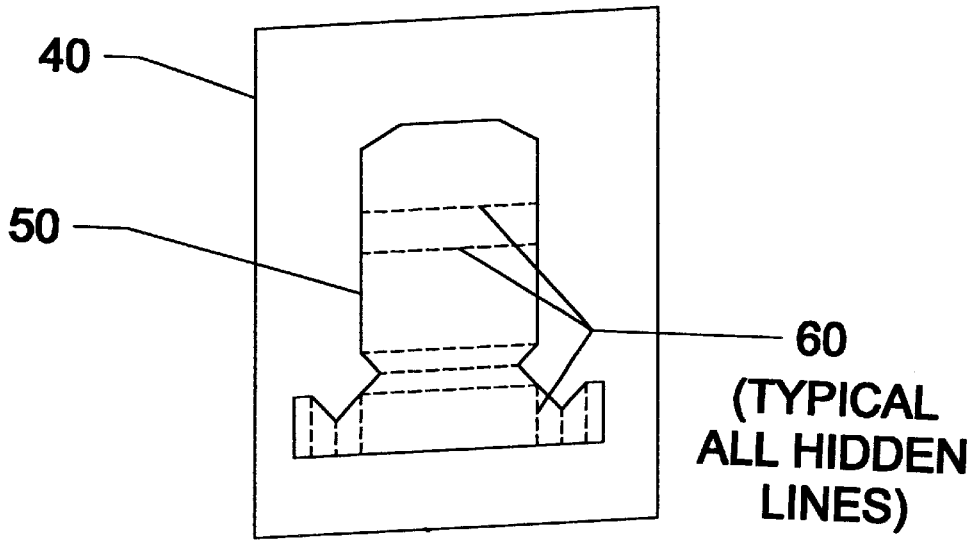
Figure 4B:
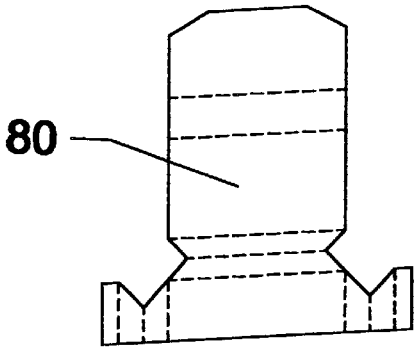
Figure 4C:
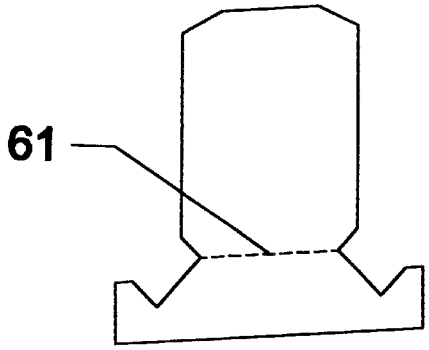
Figure 4D:
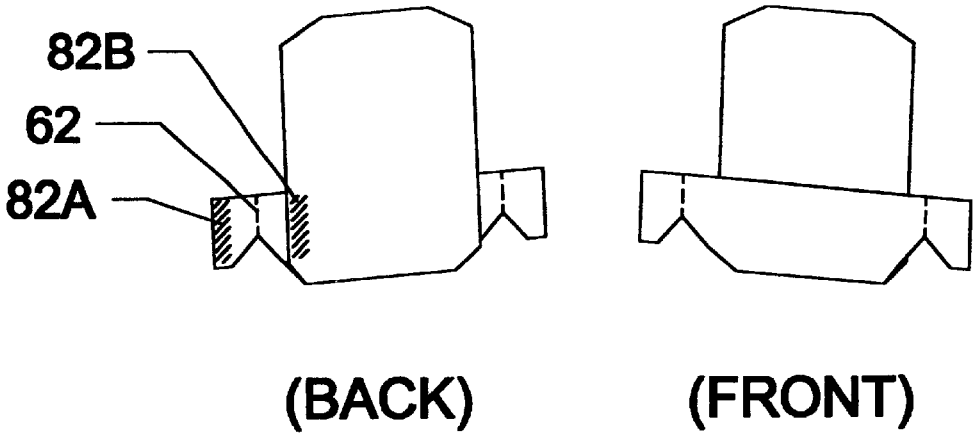
Figure 4E:
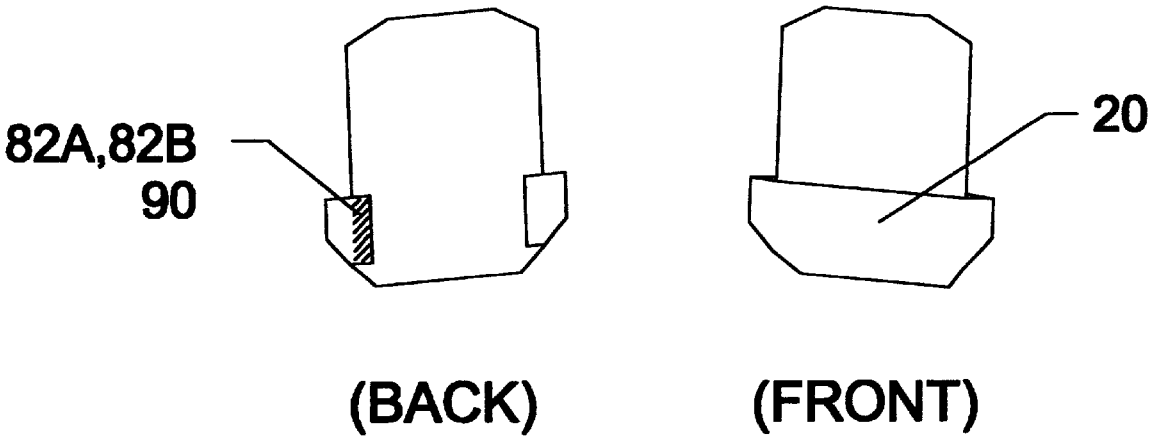
Figure 4F:
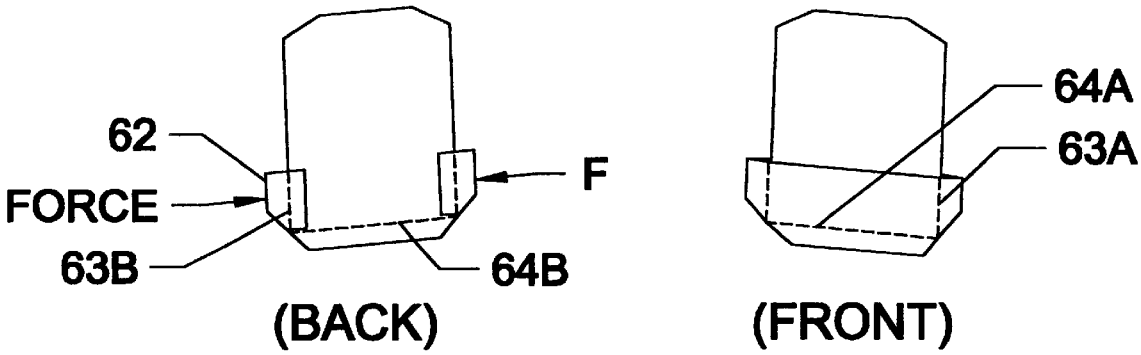
Figure 4G:
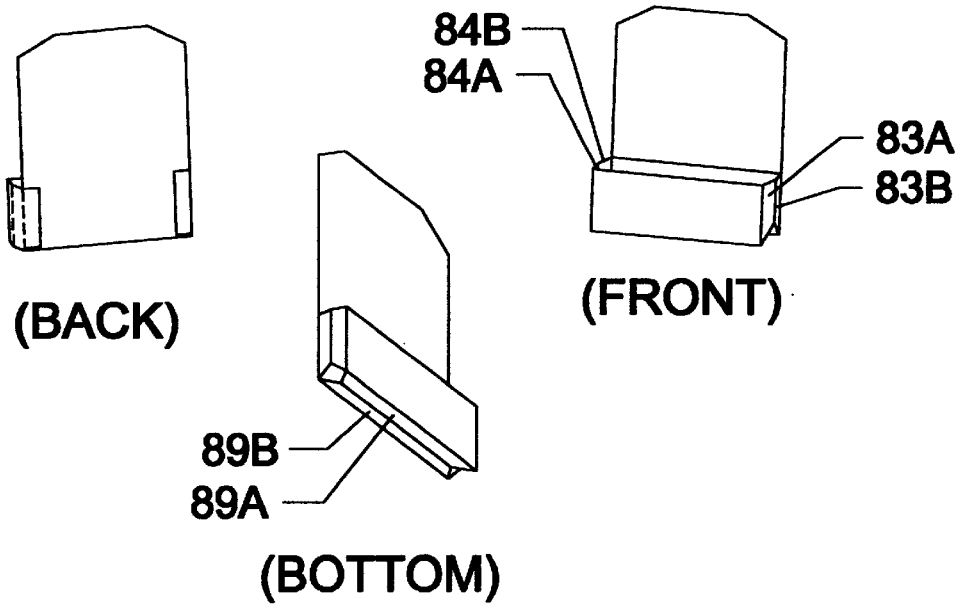
Figure 4H:
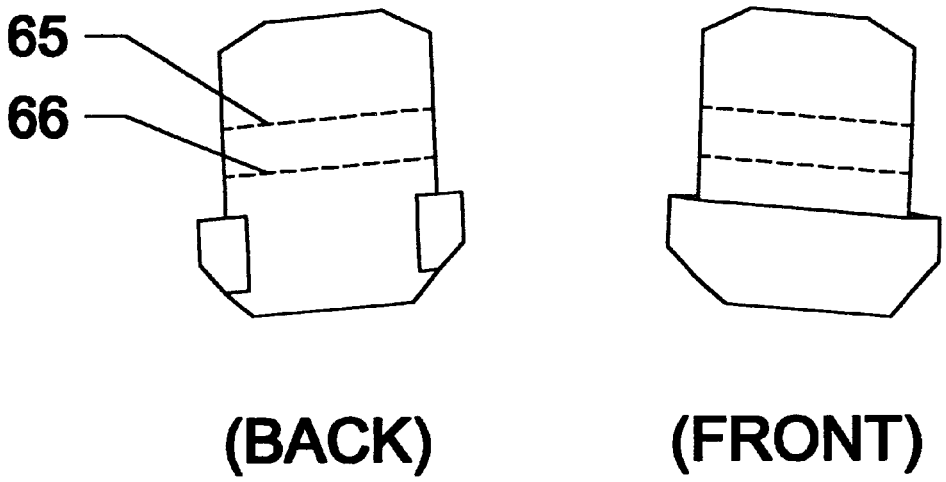
Figure 4I:
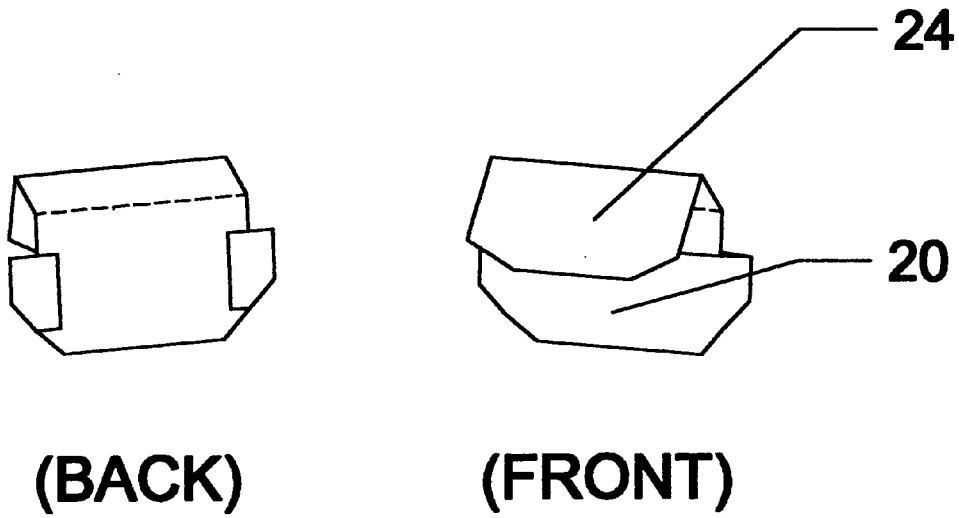
Figure 4J:
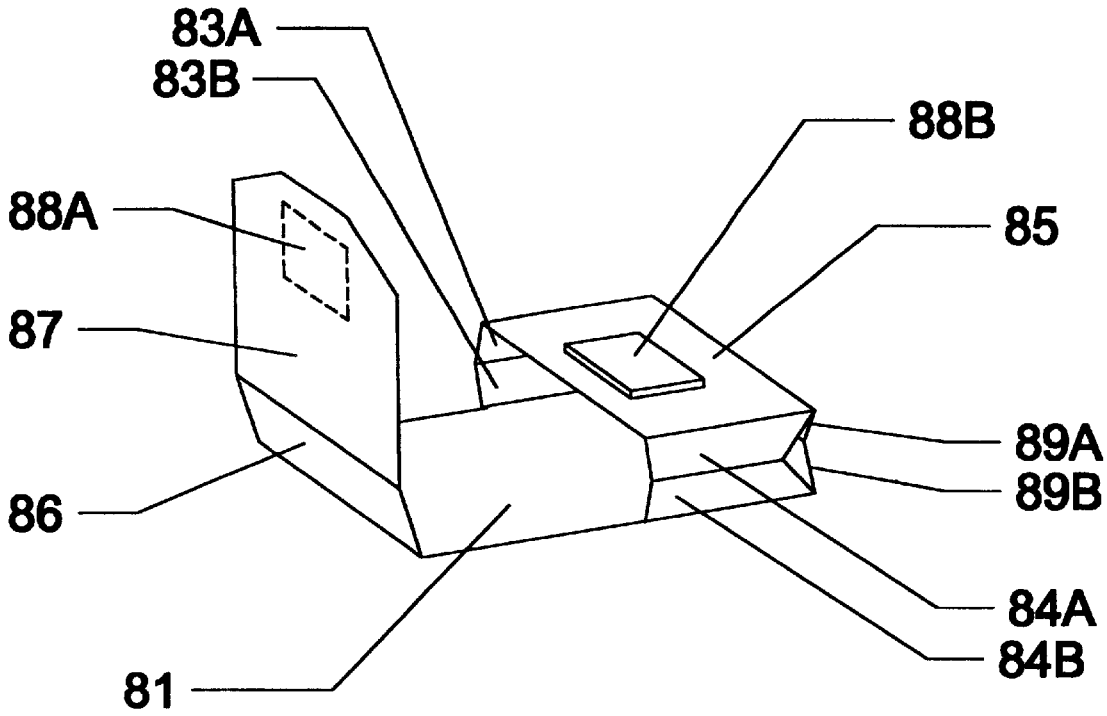
Figure 5A:
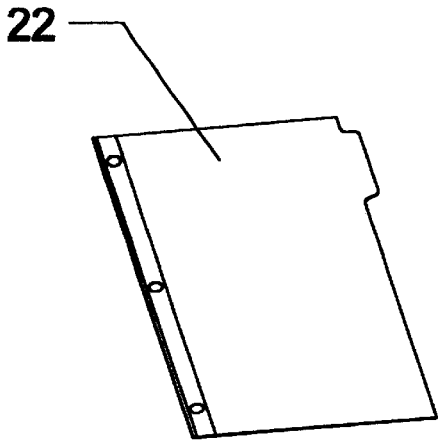
Figure 5B:
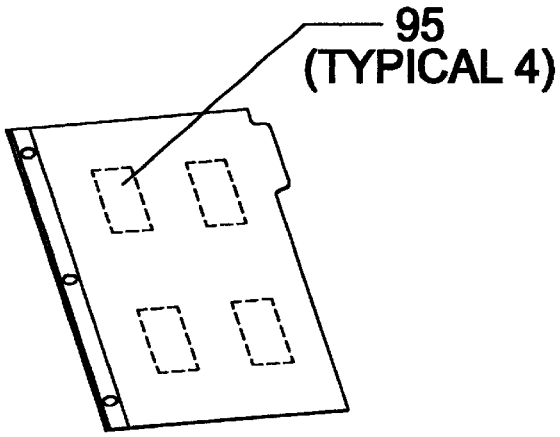
Figure 5C:
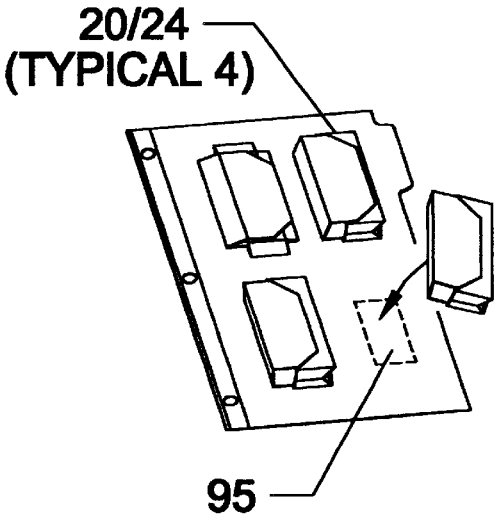
Figure 5D:
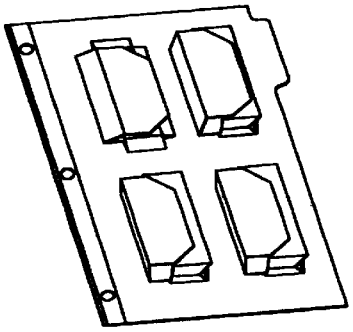

FIG. 3 shows carrier #20 and retaining-member #24 as a two-in-one unit. Construction of these two components from one piece of material is illustrated in FIG. 4-A through FIG. 4-I.

FIG. 4-A: From a heavy-weight material (cardstock #40, for example) an incision is made along perimeter-cut-line #50 (shown as a solid line). To prepare cardstock to be folded in the right places, score-lines #60 (shown as dashed lines) are impressed into the cardstock #40.

FIG. 4-B shows a fully-prepared (cut and scored) piece of cardstock, blank #80. After making the correct folds, blank #80 will form into #20 and #24. (All folds will form inward just as fingers and thumb close into a fist.) In FIG. 4-C, blank #80 is folded 180 degrees along score-line #61 resulting in the shape of that depicted in FIG. 4-D. The carrier side-walls (to be discussed in FIG. 4-G) are formed by folding along score-line #62 so that assembly-tab #82(A) rotates through 180 degrees and lands onto tab-landing #82(B). Double-back tape or glue (adhesive #90) is applied to the areas shown as cross-hatched on assembly-tab #82(A) and tab-landing #82(B). The ensuing result is shown in FIG. 4-E. Adhesive #90 (shown crosshatched) is behind assembly-tab #82(A). Here, carrier #20 is shown in collapsed condition (or flattened out).

In FIG. 4-F, carrier #20 is expanded in volume by applying force "F" onto #62 (on both ends) as illustrated. When force is applied, score-lines #63B and #64B (on back of carrier) and score-lines #63A and #64A (on the front of carrier), allow the flattened carrier to expand, or open up, into the box-shape shown in FIG. 4-G. Carrier #20 is enclosed on the right side by right-forward-panel #83A and right-aft-panel #83B. On the left side, it is enclosed by left-forward-panel #84A and left-aft-panel #84B. Its bottom portion is enclosed by Floor Forward-Panel #89A and Floor Aft-Panel #89B. Carrier #20, at this stage, is prepared to hold flashcards.

With carrier #20 again shown in the flattened condition, FIG. 4-H shows how to form retaining-member #24 by folding along score-lines #65 and #66. Carrier #20 and retaining-member #24 are called out in FIG. 4-I.

FIG. 4-J simply identifies all facets of carrier and retaining-member: Right-forward-panel #83A and right-aft-panel #83B make up carrier #20's right side. Left-forward-panel #84A and left-aft-panel #84B make up carrier #20's left side. Floor Forward-Panel #89A and Floor Aft-Panel #89B make up the carrier's bottom. Each Panel pivotally connects to each of its adjacent components, giving the carrier an accordion-like collapsing feature. The front face is #85. Front face #85's dimensions must be at least as long as the cards it will contain, but preferably its height should be less than the height of the cards so that users do not have to reach into carrier #20 to grasp flashcard(s). On the backside of carrier #20 is backwall #81. Backwall #81 shares a pivoting axis with retaining-member-top #86. Retaining-member-top #86 shares a pivoting axis with retaining-member-front #87. Some users will prefer to fasten the retaining-member-front #87 to the front-face #85. Velcro Fastener-Part A #88A (mounted to retaining-member-front #87) and Velcro Fastener-Part B #88B (mounted to carrier front face #85) will satisfy such needs. Secured retaining-member-front #87 ensures that cards remain within each respective carriers unless the user unfastens retaining-member-front #87.

FIG. 5-A–FIG. 5-D illustrate the Organizer's final assembly. FIG. 5-A shows substrate #22 (in this embodiment, it is a three-ring binder insert sheet with tabs). FIG. 5-B shows where to locate Adhesive #95 onto substrate #22. Adhesive #95 is a double back tape. FIG. 5-C illustrates three typical carrier/retainer #20/24 after being applied onto substrate #22, with the fourth carrier/retainer #20/24 in process of being applied. Each carrier/retainer #20/24 is positioned onto to the adhesive #95. The completed Organizer is shown in FIG. 5-D.

Figure 6:
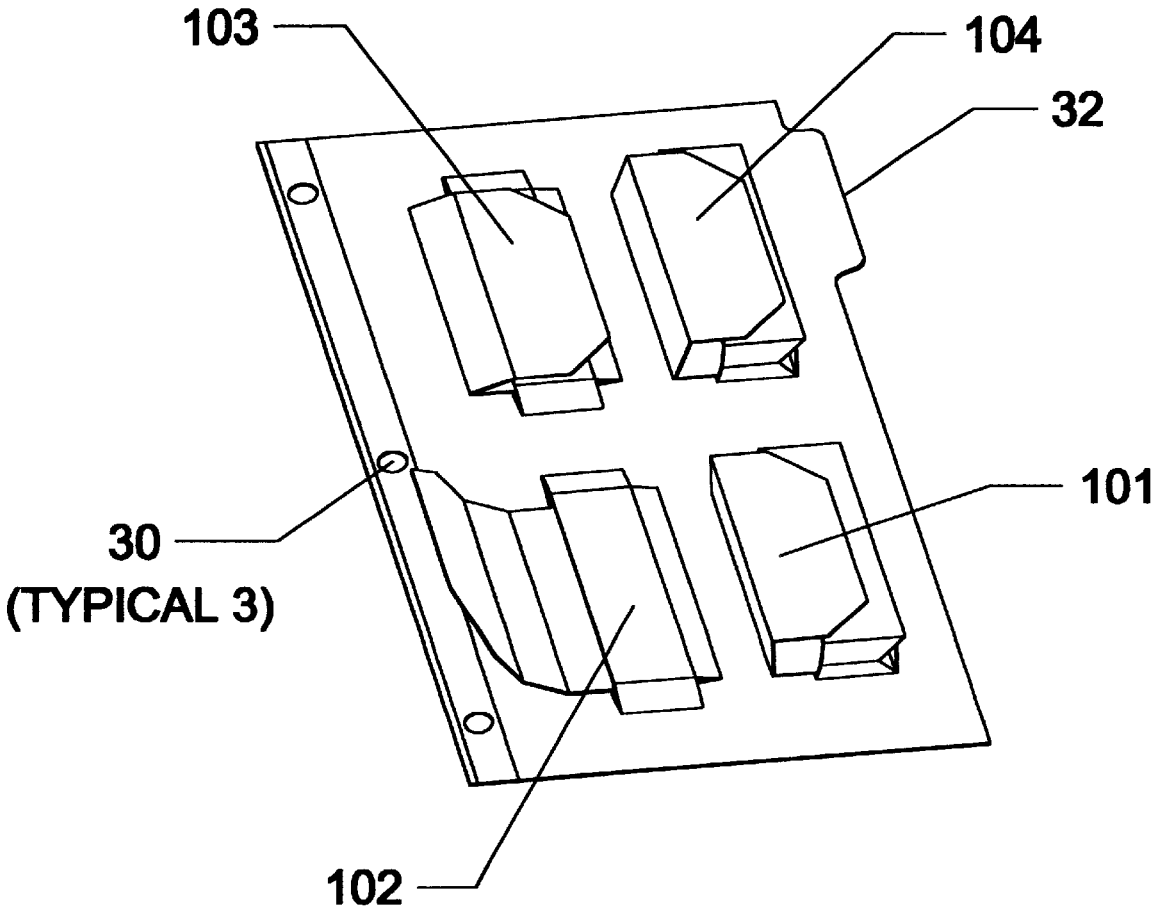
Figure 7A:
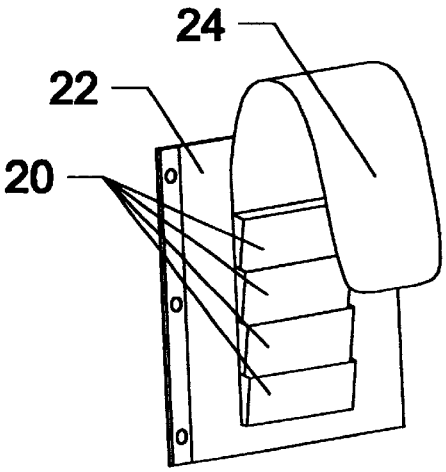
Figure 7B:
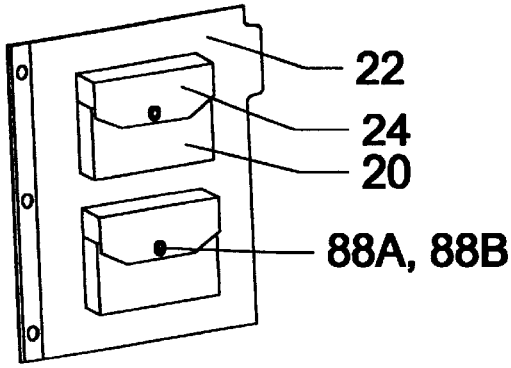
Figure 7C:
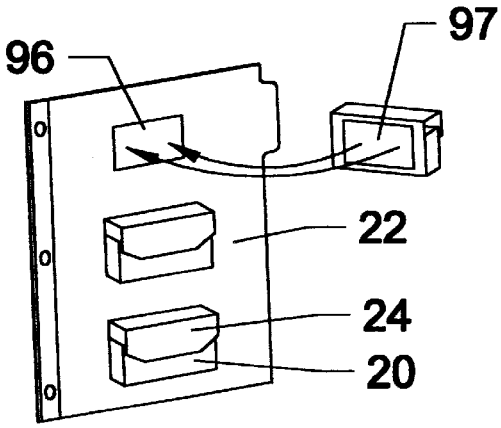
Figure 7D:
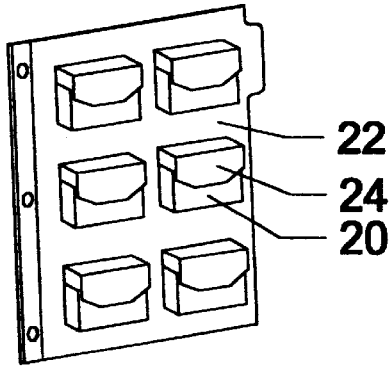

FIG. 6 shows Organizer with four pouches (carrier/retainer) #101, #102, #103, and #104. Pouch #101 is the holder for category (A) card material, while #102, #103, and #104 are for categories B, C, and D, respectively. (Pouch #101 will be a useful pouch in which a salesman puts hot-lead business cards, or for a student to keep difficult-level flashcards.) Tab #32 helps users to quickly locate Organizer held within a notebook binder (for example a student wanting to find Flashcards for "Spanish, Chapter 8" instead of flashcards for other chapters.)

OPERATION—MAIN EMBODIMENT

To help illustrate use of main embodiment, consider persons using textbooks for foreign language, law, pre-med, or history classes. As they progress through their textbooks, each new chapter will introduce new vocabulary, definitions, terminology, or facts. In some foreign language courses, for example, there will be at least 100 new vocabulary words per week. Students often use flashcards as tools to learn terminology, and they often organize their cards into groups. The Organizer is a tool to help them categorize and transport their cards.

For example, first-time users will take an empty Organizer, shown in FIG. 6. They will prepare it for use by writing the subject name onto tab #32 ("Spanish Lesson 1"). Next they insert the Organizer into a three-ring binder using the provided three-hole punches #30. With four pouches available for use, users would designate pouch #101: "Unlearned Vocabulary," pouch #102: "Intermediate-Level Vocabulary," and pouch #103: "Expert-Level Vocabulary".

As users begin their first-time review of 100 flashcards, they might find 85 words that are unfamiliar to them. These words would be assigned to pouch #101, the pouch for new words. Of the remaining 15 flashcards, users might already have familiarity with the terms. So, these words would be assigned to pouch #102, for Intermediate-Level words. If any of the 15 flashcards contained words that the user already knew, those cards would instead move directly to pouch #103 (expert-level flashcards); Once flashcards have made it to pouch #103, users no longer need to study them. Instead, they allocate their time to the words in the other pouches. Carrier #104 can be used as an auxiliary pouch to be used for blank cards, or for new cards that have not been reviewed yet, or in any other way that users choose.

On the first day of study, most cards will populate #101: "Unlearned Vocabulary." But after the second day, users will have moved, promoted, or migrated some of the original 85 flashcards upward into pouch #102, and some still, into pouch #103. There will be, however, a few flashcards whose words are especially difficult to learn. By keeping them in pouch #101 until familiarity improves, users can efficiently focus more of their time, 80% say, on just those words. After a third or fourth study session, more of the flashcards will have migrated up toward pouch #103.

The Organizer is also a flashcard transport and storage vessel as well. If at any time users wish to end their study session, they simply slide their cards into the appropriate pouch's carrier, close the retaining-member over the flashcards then close their notebook binder over the Organizer. At most, this is a five-second operation. After that, the notebook will be slipped into a backpack or be carried by hand. The flashcards will remain safely in their pouches' carriers.

For example, when users get on a bus, arrive at the cafeteria or at their home, they retrieve from their backpack the notebook, open it up to the tabbed Organizer that they were using last time, and in a brief moment, they are practicing their flashcards.

On a subsequent week, users begin a new textbook chapter and a new 100 words. At this point, they can either empty out and re-use the Organizer that they used last week, or they can allow that last-week's flashcards remain in the original Organizer, and then insert into their notebook a second Organizer for this week's flashcards. For example, they could place the new Organizer just after the previous week's Organizer and write "Spanish, Lesson 2" onto tab #32. Throughout the week, users will primarily focus on Lesson #2 words, but periodically they can revisit the Organizer for Lesson #1 to review any remaining difficult words from that chapter and test their long-term retention of words. A final advantage from using the Organizer: Words learned on a prior week—but forgotten a week later—can be demoted back down to a lower proficiency-level. Users can spend a little extra time reviewing those words that they had forgotten.

The Organizer will benefit users as they categorize and reorganize educational flashcards, business cards or other types of cards. It will prevent cards from becoming misplaced or lost. It is very mobile, can be used while commuting on a bus, at the breakfast table, at a park bench, on a walk, or in the classroom while waiting for class to begin. The Organizer is a helpful tool for last-minute review prior to a vocabulary exam.

DESCRIPTION AND OPERATION—ALTERNATIVE EMBODIMENTS

FIGS. 7-A through 7-D illustrate alternative embodiments.

FIG. 7-A: Is an Organizer with carriers #20 that are stacked diagonally (piggy-backed) one above another. The substrate is identified #22, and the retaining-member is #24. Operation of this embodiment follows that of the Main Embodiment.

FIG. 7-B: Is an Organizer for index cards. This embodiment also has optional flap fastener #88A and its mate #88B to clasp retaining member #24 to carrier #20. Generally, when the Organizer in a closed notebook, retainer #24 will remain closed by itself even with out the fasteners #88A and #88B. But some people will prefer having some sort of a closure #88A and #88B whether Snaps, Velcro, Magnetic, etc. . . .

FIG. 7-C: Is an Organizer for three-ring binder with three carriers. This Organizer is basically used the same way as that of the Main Embodiment. This embodiment also shows a carrier #24 that is removable from #22. Velcro strips #96 and #97 make the necessary provisions to accomplish this configuration. Students have the option to relocate carriers #24 to any other substrate #22 whether another three-ring binder insert or book cover, or to a Velcro strip affixed to a wall-mounted cork-board, or visor in automobile, etc. . . .

FIG. 7-D: Is an Organizer comprising six carriers oriented horizontally. Students can assign each carrier into a more-refined category. For example, this Organizer allows six organizing categories (instead of four). Students will label these carrier: "Very difficult," "Moderately Difficult," "Somewhat Difficult," "Slightly Challenging," "Easier," and "Proficient.". This Organizer may find more usage in storing business cards as well. This Organizer is basically used the same way as that of the Main Embodiment.

CONCLUSIONS, RAMIFICATIONS, AND SCOPE

The Organizer provides a portable, easy-to-use, organizing tool that can be used by any person, whether a professional or student, to organize note cards, flashcards, business cards, index cards and to optimize learning subject matter while minimizing the administrative requirements of other methods. While my above description contains many specificities, these should not be construed as limitations on the scope of the invention, but rather as an exemplification of one preferred embodiment thereof. Many other variations are possible. Examples follow.

Carrier #20's various components (front-wall #85, back-wall #81, bottom-harness #201, right-harness #202A and left-harness #202B can be constructed to be flexible or rigid, expanding or of fixed volume, changed in size, made of different material or materials, shape (square versus rounded for example), color, coating (including lamination) connected or associated with its adjacent elements in different manners (rigid or pivoting, for example), given a different mode of function, in addition to purposes already cited.

Substrate #22 can be changed in size, made of different materials, shapes, dimensions and colors.

Carriers #20 can be provided in varying quantities, layout arrangement, orientation (vertically mounted versus horizontally mounted), and can be connected onto or associated with substrate #22 using different methods or can be made integrally or separately.

Retaining-member #24 can be decreased or increased in number, changed in size, made of different material, shape, color, can be connected or associated with adjacent elements in a different manner, made integrally or separately, and can be used to cover one or more carriers. The retaining-member may be provided with or without a means to fasten it to carrier.

Means of binding #30 to a higher-level organizing system can be eliminated altogether or duplicated, made of different material or configuration, made integrally or separately.

Means of attaching carrier #20 to substrate #22 can be of permanence using any of different materials or methods (glue or tape for example), or can be made temporarily and removable using any of different materials or methods (Velcro for example).

The Organizer user, in addition to use in a three-ring binder, can be used in day planner, manila folder, or Pee-Chee.

Accordingly, the scope of the invention should be determined not by the embodiments illustrated, but by the appended claims and their legal equivalents.

I claim:

1. An organizing folio comprising:

a) a substrate, such as a three-hole punched notebook divider insert, b) a plurality of pocket-like holders called carriers each further comprising:

i) a backwall, ii) a front wall of height considerably shorter than the height of flashcards intended to occupy said carriers, iii) a bottom harness further comprising:

(1) a floor forward-panel, (2) a floor aft-panel, (3) pivotal connections:

(i) between bottom edge of said front-wall and front edge of said floor forward-panel, (ii) between back edge of said floor forward-panel and front edge of said floor aft-panel, (iii) between back edge of said floor aft-panel to bottom edge of said backwall, iv) a right harness further comprising a (1) a right-forward-panel, (2) a right-aft-panel, (3) pivotal connections:

(i) between right edge of said front-wall and front edge of said right-forward-panel, (ii) between back edge of said right-forward-panel and front edge of said right-aft-panel, (iii) between back edge of said right-aft-panel to right edge of said backwall, v) a left harness further comprising:

(1) a left-forward-panel, (2) a left-aft-panel, (3) pivotal connections:

(i) between left edge of said front-wall and front edge of said left-forward-panel, (ii) between back edge of said left-forward-panel and front edge of said left-aft-panel, (iii) between back edge of said left-aft-panel to left edge of said backwall, entire backside of said backwall connecting to said substrate, thereby connecting said carrier to said substrate, and top end of said carrier defined as that having an aperture into said carrier, said aperture's depth defined as the distance between said backwall and said front wall, and said aperture's width defined as the distance between said left harness and said right harness, c) and at least one flap-like retaining member, pivotally connected to an element chosen selectively from either said substrate or said backwall along top edge thereof, whereby a multitude of card materials can be sorted into as many groups as there are categorized carriers and be securely held therein by said retaining member, or, conversely flashcards can be retrieved from said carrier by gripping their top portion which protrude out therefrom.

2. Organizing folio of claim 1 wherein distance of separation between said retaining member and bottom of said carrier is greater then or equal to the height dimension of card materials intended to occupy said carrier, whereby said retaining member will clear the top of any card materials resting within said carriers.

3. Organizing folio of claim 2 merchandized and packaged with flashcards included therein.

4. Organizing folio of claim 3 in which said carriers are supplied with a means to temporarily fasten said retaining member to front side of said carrier, thereby covering said aperture and assuring card materials' retention within said carrier.

5. The organizing folio of claim 4 wherein said retaining member comprises a) a retaining-member top, b) a retaining-member front, c) pivotal connections:

i) between top edge of retaining-member front to front edge of said retaining-member top, ii) between aft back edge of said retaining member top to top edge of said backwall.

* * * * *